United States Patent [19]

Jalbert et al.

[11] 4,216,847

[45] Aug. 12, 1980

[54] LIFT TRUCK CONTROL

[75] Inventors: Bernard W. Jalbert, Richboro; Gerald W. Skulley, Doylestown; James A. Wahl, Langhorne, all of Pa.

[73] Assignee: Eaton Corporation, Cleveland, Ohio

[21] Appl. No.: 950,492

[22] Filed: Oct. 11, 1978

[51] Int. Cl.[2] ..... B66B 9/20

[52] U.S. Cl. ..... 187/9 R; 307/115

[58] Field of Search ..... 187/9 R, 9 E, 12, 29 D, 187/29 E, 29 G, 29 SB, 39; 414/631, 632, 663, 664, 685, 697; 74/471, 479; 200/157; 307/113, 112, 115, 135, 9, 23, 38

[56] References Cited

U.S. PATENT DOCUMENTS

| | | | |
|---|---|---|---|
| 3,235,035 | 2/1966 | Weaver, Jr. | 187/9 |
| 3,811,336 | 5/1974 | Pulskamp | 74/471 |
| 3,823,616 | 7/1974 | Houseman | 74/471 |
| 3,891,906 | 6/1975 | Chist | 307/38 |
| 4,004,156 | 1/1977 | Schuller | 307/113 |
| 4,095,123 | 6/1978 | Takahashi | 307/115 |

*Primary Examiner*—Kenneth W. Noland

*Attorney, Agent, or Firm*—R. J. McCloskey; F. M. Sajovec, Jr.

[57] ABSTRACT

A multiple function control for an electric lift truck which facilitates moving the truck while the load carriage is being raised or lowered. Two vehicles speeds in forward and reverse can be selected by means of a pair of pushbuttons (34, 36) located on the load carriage lift control handle (32), independent of the normal vehicle travel control (28). Circuit means are provided to prevent simultaneous selection of both forward and reverse drive motor directions and to prevent adverse results from simultaneous operation of the normal vehicle travel control and the pushbutton control.

12 Claims, 3 Drawing Figures

LIFT TRUCK CONTROL

This invention relates to industrial trucks, and more particularly to a multiple function control system for an electrically powered industrial truck.

Multiple function controllers are well known in the art. U.S. Pat. No. 3,811,336 discloses an industrial truck controller in which a single control handle is movable about multiple axes to control the speed and direction of the truck, load carriage lift and lower, mast tilt, and other hydraulic functions. U.S. Pat. Nos. 3,235,035 and 3,823,616 disclose other types of multiple function controllers for electric industrial trucks.

The primary purpose for offering multiple function control in an industrial truck is to make it easier for an operator to simultaneously handle a load and maneuver the truck.

It has been found that in many cases having all hydraulic functions other than steering incorporated in a single control element is not necessarily an ideal condition, since the added complexity can make it more rather than less difficult to efficiently operate the vehicle.

One form of simplified multiple function control provides a variable vehicle direction and speed control, with a pushbutton on the speed control handle to provide a single lift speed. It has been found, however, that a single lift speed does not provide sufficiently precise control for many lifting operations.

Heretofore, precise vehicle speed control was considered to be of prime importance, with only minimal controls provided for the other functions, such as lift, which may be performed as the vehicle is moving.

The present invention stems from the realization that in many cases precise control of the lifting function should be of prime importance, and that precise vehicle speed and direction control is not nearly as important as it was heretofore considered to be.

Accordingly, what the present invention provides is a control system for an industrial truck, which provides a conventional, infinitely variable vehicle speed and direction control, an infinitely variable control for the load carriage lifting function, and pushbutton controls on the lift control handle to provide an auxiliary two-speed forward and reverse vehicle control. In accordance with a further aspect of the invention, means are provided to prevent any harmful results if the normal vehicle speed control and the pushbutton speed controls are actuated simultaneously, and to prevent simultaneous selection of both forward and reverse vehicle directions.

Other features of the invention will become apparent from the following description in conjunction with the accompanying drawings, wherein.

Figure 1:
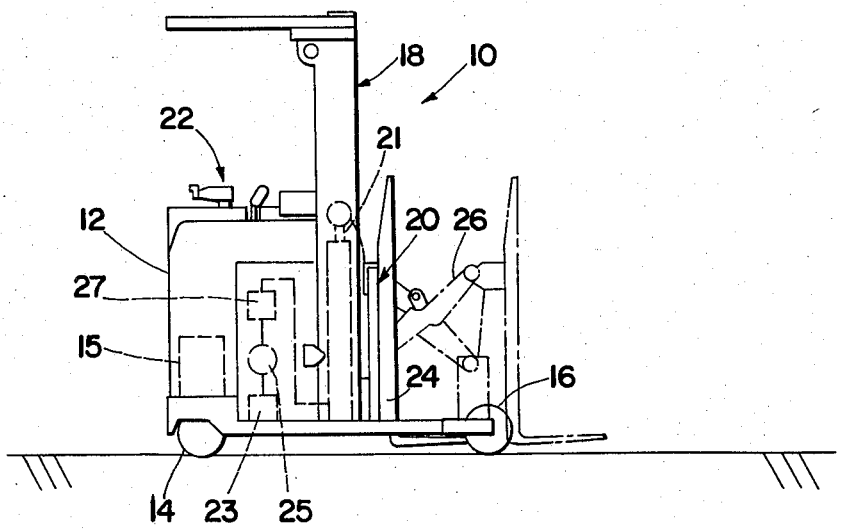
FIG. 1 is a side elevation view of an electric lift truck incorporating the invention.

Referring to the drawings, FIG. 1 illustrates an electric lift truck 10 including a frame 12, a pair of drive wheels 14, a traction motor 15 connected to the drive wheels, a pair of load wheels 16, a mast assembly 18, a load carriage assembly 20 movably attached to the mast, and an operator's station designated generally by the numeral 22. In the illustrative embodiment the load carriage assembly comprises a pair of load forks 24, and a reach mechanism 26, shown in broken line in its extended position. The load carriage assembly 20 is raised and lowered by means of a hydraulic cylinder 21, which is part of a hydraulic circuit including a motor 23, a pump 25, and a control valve 27.

Figure 2:
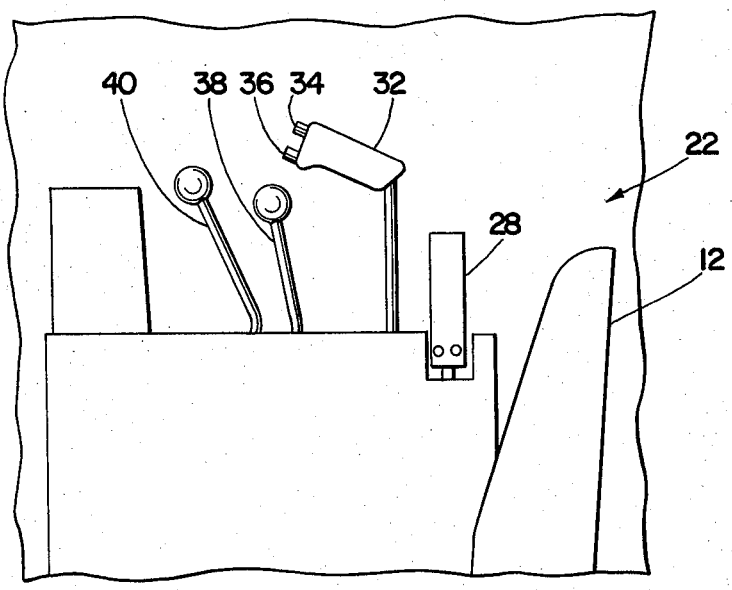
FIG. 2 is a partial rear elevation view of the vehicle of FIG. 1.

Referring to FIG. 2, the operator's station 22 includes vehicle controls comprising a travel or speed and direction control handle 28 for normally selecting vehicle direction and infinitely varying the vehicle speed in either the reverse or forward direction, a load carriage lift and lower handle 32 which also includes a forward speed control button 34 and a reverse speed control button 36 in accordance with the invention, a fork tilt control handle 38, and a reach mechanism control handle 40. The load carriage handle 32 is connected to the control valve 27 to control lifting and lowering of the load carriage.

In accordance with the invention, when an operator is handling a load carried by the load carriage 20 by manipulating the lift control handle 32, the fork tilt control handle 38 and the reach mechanism control handle 40, he can simultaneously select one of two forward and reverse speeds by means of the pushbuttons 34 and 36 on the lift control handle 32, without removing his hand from the lift control handle, and without using the travel handle.

Figure 3:
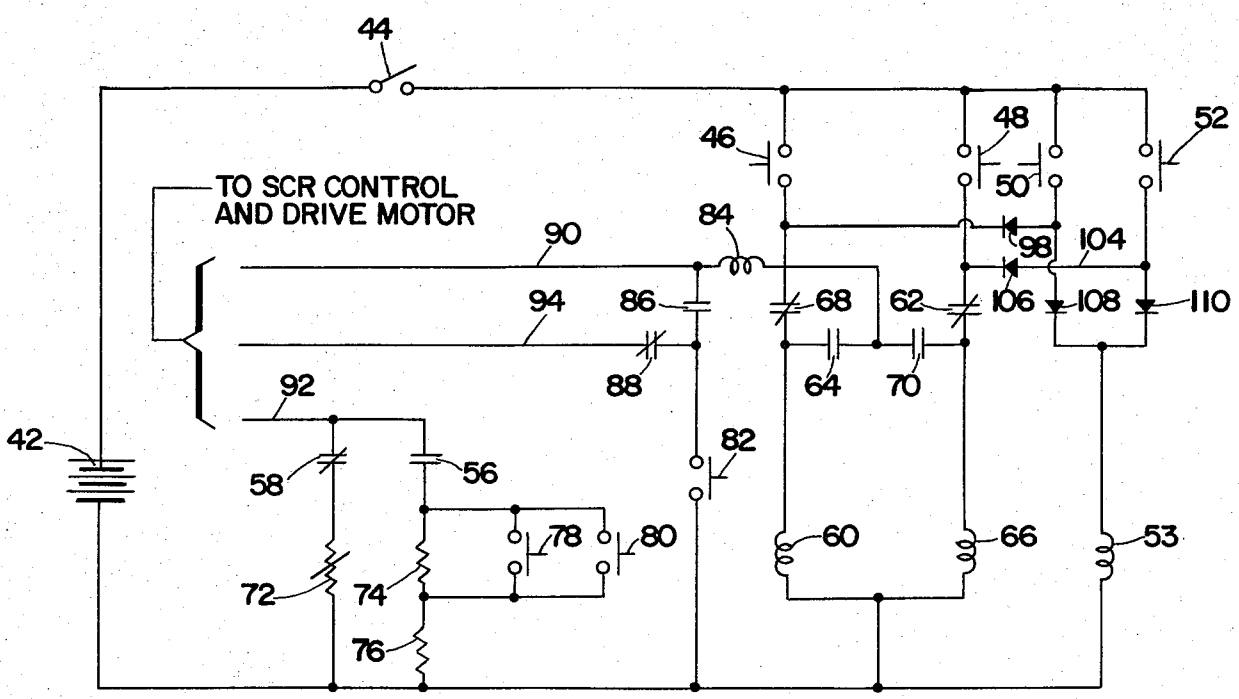
FIG. 3 is a simplified schematic diagram of the electrical system of the vehicle of FIG. 1, incorporating the invention.

FIG. 3 is a partial schematic illustration of the electrical control circuit for the drive motor 15 of lift truck 10. The circuit comprises a battery 42, a master switch 44 in series with the battery, momentary contact switches 46 and 48 which are closed when the travel handle 28 is moved to its forward and reverse positions, respectively, a low speed forward momentary contact switch 50 actuated by movement of the forward pushbutton 34 to a first position, a low speed reverse momentary contact switch 52 actuated by movement of the reverse pushbutton 36 to a first position, a relay coil 53 which is connected in series with the switches 50 and 52 to close a normally open relay contact 56 and open a normally closed relay contact 58, a forward contactor coil 60 which is connected in series with switch 46 to open a normally closed relay contact 62 and close a normally open relay contact 64, a reverse contactor coil 66 which is connected in series with switch 48 to open a normally closed relay contact 68 and close a normally open relay contact 70, a potentiometer 72 connected in series with the relay contact 58 and actuated by movement of the travel handle 28, a pair of resistors 74 and 76 connected in series with relay contact 56 and in parallel with potentiometer 72 and relay contact 58, a forward momentary contact switch 78 connected in parallel with resistor 74 and actuated by movement of pushbutton 34 to a second position, and a reverse momentary contact switch 80 connected in parallel with switch 78 and actuated by movement of pushbutton 36 to a second position. The drive motor is controlled by a conventional SCR electric vehicle control such as the General Electric Model 200, will not be described in detail herein.

The drive motor control circuit further includes a bypass circuit comprising a momentary contact switch 82 actuated when the travel handle 28 is moved to nearly its full speed forward and reverse positions, a relay coil 84, and a normally open relay contact 86 closed by energization of the coil 84. Normally closed relay contact 88 is opened by the energization of coil 54, as will be described later.

Under normal travel conditions, when forward travel of the vehicle is desired, the travel handle 28 is moved to the forward position, closing switch 46, and energizing coil 60 to open relay contact 62 and close relay contact 64. Closing of relay contact 64 applies power to the SCR control logic, thus energizing the drive motor, through line 90. In this mode of operation there is insufficient current in coil 84 to energize it, thus relay contact 86 remains open. Vehicle speed is controlled by the accelerator potentiometer 72, which is connected in series with a pulsing circuit of the SCR control via line 92. Normal operation in the reverse direction is the same, except that switch 48 is closed, energizing coil 66 and associated circuitry.

Just before the travel handle 22 reaches its full speed position in either direction, bypass switch 82 is closed, connecting line 94 to the SCR control to battery negative and initiating a time delay within the SCR control circuitry. At the end of the time delay line 90 is connected to battery negative, energizing coil 84 and removing the control voltage from the SCR. With the SCR shorted out the drive motor 15 is connected directly across the battery 42. Closing switch 82 is also effective to energize coil 84, which closes relay contact 86, removing coil 84 from the control circuitry.

If the vehicle operator desires to travel while he is manipulating the lift and lower handle 32, two speeds in each direction of travel can be selected by depressing either one of the two pushbuttons 34 or 36. If slow speed forward is selected by depressing pushbutton 34 to a first position, switch 50 will be closed, energizing contactor coil 60 via line 96 through diode 98. Closing switch 50 also energizes coil 53, closing normally open contact 56, and opening normally closed contact 58 and normally closed contact 88. The opening of contact 58 removes the potentiometer 72 from the pulsing circuit of the SCR control. The closing of contact 56 inserts resistors 74 and 76 into the pulsing circuit to cause low speed operation. The opening of normally closed contact 88 prevents actuation of the bypass circuit when vehicle movement is being controlled by the pushbuttons 34 and 36. Reverse slow speed operation is obtained in the same way except that pushbutton 36 is depressed to a first position, closing switch 52 and energizing coil 66 through line 104 via diode 106. Diodes 108 and 110 prevent reverse current flow in the circuits of switches 50 and 52.

If high speed forward is desired, pushbutton 34 is depressed to a second position, which closes switch 78, while switch 50 remains closed. The closing of switch 78 shorts out resistor 74, thus providing a higher speed. For high speed reverse operation, pushbutton 36 is depressed to its second position, closing switch 80, also shorting out resistor 74.

As described above, when the forward contactor coil 60 is energized, normally closed contact 62 is opened, such that inadvertent actuation of reverse pushbutton switch 52 while the vehicle is travelling forward has no effect on the vehicle. Likewise, when reverse contactor coil 66 is energized, normally closed contact 68 is opened. If both pushbutton switches are depressed simultaneously, nothing will happen since both contacts 62 and 68 will open.

If both the normal forward travel switch 46 and forward pushbutton switch 50 are closed, the vehicle will travel forward at a speed determined by the position of the pushbutton, since the normally closed contactor 58 will be opened by coil 53 thus removing the potentiometer 72 from the circuits. Since the operator's station 22 is preferably designed so that the travel handle 28 and the lift and lower handle 32 are controlled by the same hand, it is unlikely that both modes of forward travel will be selected at the same time. If they are, however, no harm will result.

We claim:

1. In an electric lift truck having a drive motor, a load lifting carriage, a hydraulic system for operating the load lifting carriage, an electrical control system for controlling the speed and direction of the drive motor, first drive motor control means operatively connected to said electrical control system and movable to select forward or reverse direction and to infinitely vary the speed of said drive motor, lift control means operatively connected to said hydraulic system to control lifting of said load carriage, and second drive motor control means located on said lift control means and operable to select at least one predetermined drive motor speed and one drive motor direction independent of the first drive motor control means.

2. Apparatus as claimed in claim 1, in which said electrical control system includes a battery, an SCR control, first switch means actuated by said first drive motor control means and operable to selectively close a circuit to said SCR control to select a direction of operation of said drive motor, a potentiometer connected between said SCR control and said first switch means to infinitely vary the speed of said drive motor, and second switch means actuated by said second drive motor control means and operable to selectively close said circuit to the SCR control, closing of said second switch means being effective to bypass said potentiometer.

3. Apparatus as claimed in claim 2, in which said first drive motor control means comprises a hand operated lever operatively connected to said first switch means and to said potentiometer.

4. Apparatus as claimed in claim 2, in which said drive motor control system includes a first fixed resistor connected in parallel with said potentiometer, a first normally open relay contact connected in series with said first fixed resistor, a first normally closed relay contact connected in series with said potentiometer, and a first contactor coil energized by closing said second switch means, energization of said first contactor coil being effective to open said first normally closed relay contact and to close said first normally open relay contact.

5. Apparatus as claimed in claim 4, including a second fixed resistor in series with said first fixed resistor, and third switch means actuated by said second drive motor control means, said third switch means being effective to short out said second fixed resistor when said third switch means is closed.

6. Apparatus as claimed in claim 5, in which said second drive motor control means comprises a two-position pushbutton, wherein said second switch means is actuated when said pushbutton is in a first position, and said third switch means is actuated in addition to said second switch means when said pushbutton is in a second position.

7. Apparatus as claimed in claims 4, 5 or 6, including bypass circuit means operable to remove said SCR control from said drive motor control system and connect said drive motor directly to said battery, and a second normally closed relay contact connected between said SCR control and said bypass circuit, said second normally closed relay contact being opened by the energization of said first contactor coil to prevent removal of said SCR control from said drive motor control circuit when said second switch means is closed.

8. Apparatus as claimed in claim 2 including bypass circuit means operable to remove said SCR control from said drive motor control system and connect said drive motor directly to said battery, said bypass circuit comprising a bypass switch actuated by movement of said first drive motor control means to a predetermined position, the closing of said bypass switch being effective to connect a portion of said SCR control to ground.

9. Apparatus as claimed in claim 8, including means energizable by the closing of said second switch means operable to prevent connection of said portion of said SCR control to ground.

10. Apparatus as claimed in claim 8, in which said bypass circuit includes a second contactor coil energized by closing said bypass switch, and a second normally open relay contact connected between said bypass switch and said second contactor coil, energization of said second contactor coil being effective to close said second normally open relay contact.

11. Apparatus as claimed in claim 1, in which said hydraulic system includes a pump, a hydraulic cylinder operatively connected to said load carriage, and a valve connected between said pump and said cylinder for selectively supplying pressurized hydraulic fluid to said cylinder, said lift control means comprising a control handle operatively connected to said valve.

12. Apparatus as claimed in claims 2, 11 or 3, in which said second drive motor control means comprises a pushbutton located on said lift control means and operatively connected to said second switch means.

* * * * *